United States Patent [19]

Walton et al.

[11] Patent Number: 4,782,429

[45] Date of Patent: Nov. 1, 1988

[54] LONG-LIFE LUMINAIRES

[76] Inventors: John F. Walton, 6853 Strata St., McLean, Va. 22101; Al R. Roshdieh, 688 College Pkwy., Rockville, Md. 20850

[21] Appl. No.: 37,230

[22] Filed: Apr. 10, 1987

[51] Int. Cl.[4] ..... F21V 19/04

[52] U.S. Cl. ..... 362/20; 362/212; 313/316

[58] Field of Search ..... 362/20, 21, 211, 212, 362/240, 254; 315/65, 66, 67; 313/579, 316, 373

[56] References Cited

U.S. PATENT DOCUMENTS

| | | | |
|---|---|---|---|
| 1,313,857 | 8/1919 | Dennington | 362/211 |
| 1,720,311 | 7/1929 | Becket | 362/211 |
| 1,760,667 | 5/1930 | Sproesser et al. | 315/65 |
| 1,839,479 | 1/1932 | Hartman | 362/226 |
| 2,042,963 | 6/1936 | Rentschler et al. | 315/58 |
| 2,161,443 | 6/1939 | Warshawsky | 315/65 |
| 3,295,007 | 12/1966 | Young | 313/316 |
| 4,023,060 | 5/1977 | Pike et al. | 313/273 |
| 4,096,405 | 6/1978 | Goto | 313/174 |
| 4,185,219 | 1/1980 | Kamio | 313/279 |
| 4,272,698 | 6/1981 | Oyama et al. | 313/272 |
| 4,285,032 | 8/1981 | Honda et al. | 362/224 |
| 4,287,452 | 9/1981 | Fernandez | 315/65 |
| 4,461,974 | 7/1984 | Chiu | 315/65 |
| 4,596,944 | 6/1986 | Gorstein | 315/185 R |

FOREIGN PATENT DOCUMENTS

| | | | |
|---|---|---|---|
| 237105 | 11/1964 | Fed. Rep. of Germany | 362/211 |
| 2605888 | 8/1976 | Fed. Rep. of Germany . | |
| 1364872 | 5/1964 | France | 362/335 |
| 0003284 | 1/1977 | Japan | 315/65 |
| 235191 | 12/1925 | United Kingdom | 315/65 |

*Primary Examiner*—Charles J. Myhre
*Assistant Examiner*—David A. Okonsky
*Attorney, Agent, or Firm*—Hall, Myers & Rose

[57] ABSTRACT

There is provided a luminaire primarily for use with exit signs and other emergency-type lighting comprising a series string of low-voltage, extremely long-life filaments positioned within a sealed enclosure for protection and electrically connected to a standard base whereby luminaires having lives of 10 to 30 years may replace standard bulbs without the requirement of retrofitting.

10 Claims, 1 Drawing Sheet

LONG-LIFE LUMINAIRES

BACKGROUND OF THE INVENTION

The present invention relates to electric lights and, more particularly, to extremely long-life luminaires for illuminating exit signs, and related emergency signs and the like, which luminaires do not require retrofitting of the fixtures with which they are used.

The bulbs currently available for emergency light fixtures such as exit signs have, considering their intended use, short lives of the order of 300 to 2000 hours with, as would be expected, shorter lives for individual units within this group. The cost of constantly checking, maintaining, and replacing bulbs is estimated to be at least $100 per year per fixture for outside maintenance and $60 per year for in-house maintenance.

A related and more significant problem relating to these fixtures is the danger to humans if exit signs and the like are not illuminated due to burned-out bulbs and the exits in a burning or damaged building cannot be found. Deaths resulting from such occurrences are possible and in addition to human suffering there is the ever-present threat of expensive and protracted litigation.

There is a significant need for luminaires with extended life, say, on the average, five- to ten-year lives with a guaranteed three- to five-year life. The savings in lives, injuries, maintenance costs, damages, and lawsuits would be highly significant with the availability of such a luminaire, particularly one that does not require retrofitting of existing fixtures. It is believed that this latter feature, although not essential to a successful product, is in fact significant.

SUMMARY OF THE INVENTION

The present invention provides one of several different standard lightbulb bases, a sealed glass tube, clear or appropriately frosted, and located within the sealed tube a series string of small, fifty thousand-hour, 14-volt filaments. If operated at 14 volts, these filaments have a typical life of, as indicated, fifty thousand hours but if operated at 12 volts, 10 filaments in series, the expected life is about 11 years. The life of an individual filament may be less than the calculated life, and thus the average life of the string operated at 12 volts will statistically be less than 11 years, and a guaranteed life of 5 years is quite plausible.

If a longer guaranteed life is desired, then two strings of filaments may be included in a single tube with or without a switch-over from one string to a second string upon failure of the one string.

To lessen the danger of shortened life due to large voltage surges, a varistor may be connected across the two electrical ends of the string. Also, one of the filaments may be replaced by a long-life current-limiting resistor or inductor to further extend the guaranteed life of the individual filaments.

A series string of 8 to 10 filaments of the type contemplated for use herein provides as much and usually more light than the bulbs currently employed for emergency sign lighting. By using standard bases, the lights of the present invention may be screwed or plugged into standard bases in a single replacement operation.

DETAILED DESCRIPTION OF THE INVENTION

Figure 1:
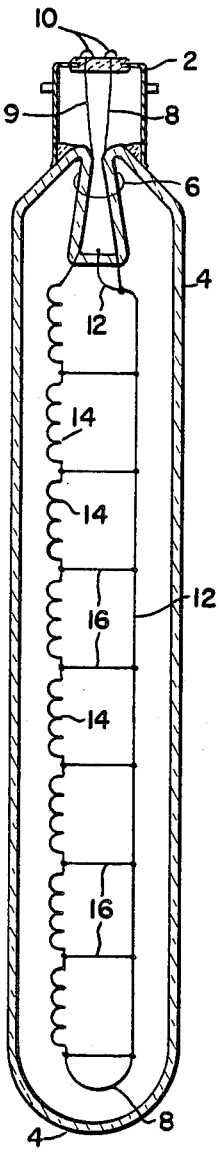
FIG. 1 is a side view of one embodiment of the present invention.

Referring now specifically to FIG. 1 of the accompanying drawings, there is illustrated one embodiment of the luminaires of the present invention.

A standard lamp base 2, in this embodiment a bayonet-type base, has mounted thereon a glass envelope or tube 4 sealed at end 6 secured to the tube. A pair of wires 8 and 9 extend through the seal and are each connected to a different one of contacts 10. Also secured in the seal is a conductive support 12 extending along the length of the tube. The wire 8 is electrically connected to support 12. The wire 9 is connected interiorly of the tube to one end of a string of eight filaments 14, the end being connected to support 12. Glass bead insulated supports 16 extend from support 12 to the region between each pair of filaments.

The filaments, which preferably should be ten in number, are of the low-voltage, long-lived variety such as those used in Catalog #CM-2182 bulbs produced by Chicago Miniature Lamp Works. If operated at 14 volts, eight filaments to the string, expected life is 50,000 hours. If ten filaments are included in the string, the voltage drop across each filament is reduced to ten volts and life expectancy is increased to eleven years, thus permitting a guarantee of five years.

Figure 2:
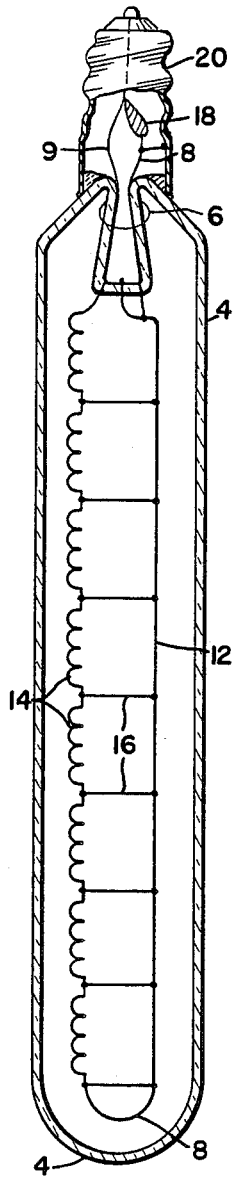
FIG. 2 is a side view of a second embodiment of the present invention.

Referring to FIG. 2 of the accompanying drawings, there is illustrated the luminaire of FIG. 1 with the addition of a varistor 18 connected across the two ends of the string of filaments. The purpose of this element is to isolate the filaments from high-voltage surges. It will be noted that a standard screw-in base 20 is employed.

Figure 3:
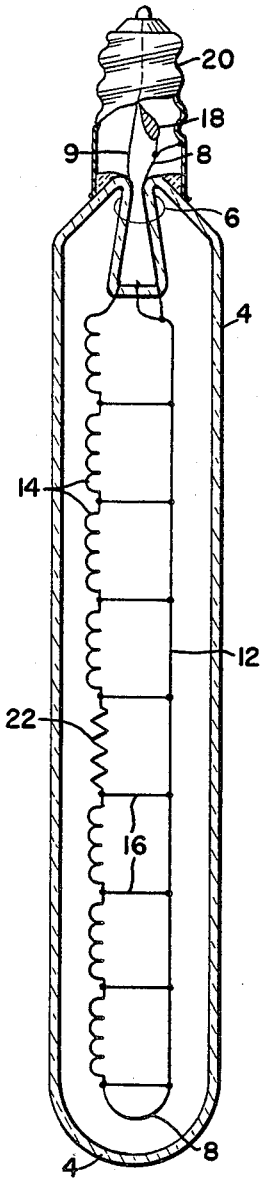
FIG. 3 is a side view of a third embodiment of the present invention.

Reference is now made to FIG. 3, which illustrates a luminaire that is the same as illustrated in FIG. 2, with the addition of a long-life resistor 22 in replacement of one of the filaments. This resistor is employed to reduce the effects of surge currents upon lamp turn-on. If the resistor has a resistance equal to that of the average value of one of the filaments in incandescent condition, and there are nine filaments in serieswwith the resistor 22, the turn-on in-rush of surge current is reduced to $\frac{1}{4}$ to $\frac{1}{3}$ of its value in the absence of the resistor 22. The quality of the current limiting is such that moderately high voltages and momentary surges are handled without degradation. If the resistor 22 is placed in the approximate middle of the string, the light is decentralized, which is useful in providing more uniform lighting. With standard luminaires in exit signs or luminaires of the present invention as set forth in the prior figures, the light appears to be concentrated in the center.

Improved light distribution may also be achieved by the unequal distribution of the individual filaments. The filaments may be more widely spaced in the middle, thus reducing the appearance of light concentration in the middle.

Figure 4:
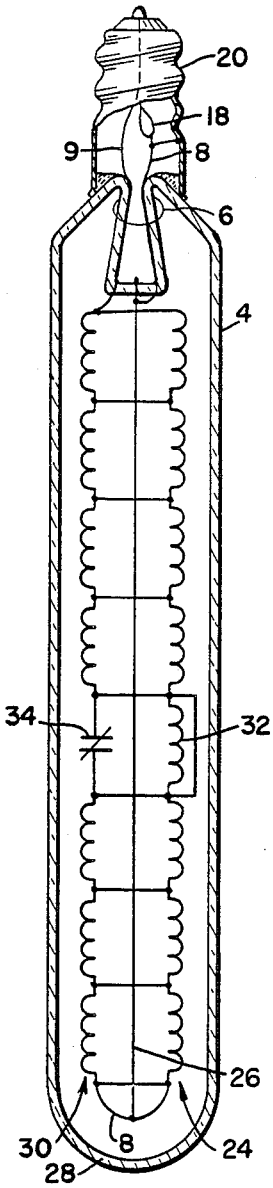
FIG. 4 is a side view of a fourth embodiment of the present invention.

Reference is now made to FIG. 4 of the accompanying drawings, wherein is illustrated a luminaire having two serial strings of filaments in parallel and a relay for switching over to a second of the strings when a first string fails.

Specifically, a first string of filaments 24 is connected between the lead 9 and the lead 8 at the end of a center conductor support 26 remote from the base. Again, the string is located interiorly of a sealed glass cylinder 28.

A second string of filaments 30 also extends between the remote end of the center conductor 26 and the lead 9. The string 24 has a relay coil 32 connected in series with the string, preferably in the center thereof, and a normally closed contact 34 of the relay coil 32 connected in series with the string 30. The normally closed contact 34 is heldopen as long as the string 24 is intact. Upon failure of a filament of the string 24 or the relay coil, the contact 34 closes and the string 30 is energized.

Such an arrangement greatly extends, essentially doubles, the expected life of the unit and makes it much less likely to have premature failures. Premature failures can occur, as with any luminaire. The possibility of such a failure is greatly reduced in this situation. In still another arrangement two strings of filaments are in parallel all of the time, providing equal protection against premature failure as the arrangement of FIG. 4 but extending life only to a limited extent.

The relay employed may be either an AC relay or a DC type with a diode connected across the coil or an AC or DC type in a bridge rectifier with or without a capacitor connected across the coil.

Figure 5:
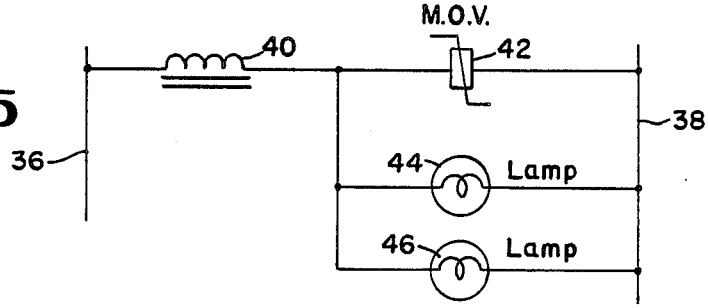
FIG. 5 is a circuit diagram of the input supply to the luminaire of the present invention.

It should be noted that the life of the filaments and of the varactor, if used, can be further extended by using a surge-limiting coil in the line to the luminaire. Such an arrangement is illustrated in the circuit diagram of FIG. 5. Specifically, the AC lines 36 and 38 have connected across them an inductor 40 and varistor 42 in series. The fixtures in which these,luminaires are used usually have two bulbs, which in FIG. 5 are represented by bulbs 44 and 46, which, in the present invention, are each replaced by any one of the luminaires of the present invention. The inductor 40 is chosen to have low reactance at 60 Hz providing low losses in normal operation compared to a resistor. High transients, however, are highly attenuated by the inductor protecting both the bulbs and the varistor from large over voltages.

In alternative forms the reactor can be replaced by a resistor, and the varactor can be replaced by a capacitor. Both of these forms, however, are not as effective as that described relative to FIG. 5.

The present invention thus provides a luminaire that may be inserted into a standard light fixture and has a life that is measured in numbers of years rather than in months. In use with illuminated exit signs and in emergency lighting situations, the cost of the bulbs of the present invention reresents only a fraction of the annual cost of servicing and maintaining emergency signs.

Other improvements, modifications, and embodiments will become apparent to one of ordinary skill in the art upon review of this disclosure. Such improvements, modifications, and embodiments are considered to be within the scope of this invention as defined by the following claims:

We claim:

1. A long-life luminaire comprising:

a string of long-life, low-voltage filaments;

said filaments becoming incandescent when heated;

means adapted to connect said filaments in series across a source of electrical energy;

a long-lived resistor connected in series with said string;

said resistor having a resistance at least equal to that of one of said filaments when incandescent.

2. The long-life luminaire of claim 1 wherein a number of filaments are included in said string to maintain the voltage across each filament at approximately 12 volts.

3. The long-life luminaire of claim 1 wherein a number of filaments are included in said string to maintain the voltage across each filament to 14 volts.

4. The long-life luminaire of claim 1 or claim 2 or claim 3 further comprising:

a sealed evacuated tube;

said string of filaments located in said evacuated tube.

5. The long-life luminaire of claim 4 wherein said tube is filled with an inert gas.

6. The long-life luminaire of claim 4 wherein said tube is filled with a halogen.

7. The long-life luminaire of claim 4 further comprising:

a second string of filaments in parallel with said first-mentioned string of filaments.

8. The long-life luminaire of claim 7 further comprising:

means for initially energizing one of said strings of filaments and responsive to failure of said one of said strings to energize the other of said strings.

9. The long-life luminaire of claim 1 further comprising: a varistor connected in parallel with across said string.

10. A long-life luminaire comprising:

a string of long-life, low-voltage filaments;

said filaments becoming incandescent when heated;

means adapted to connect said filaments in series across a source of electrical energy;

a sealed envelope within which said filaments are located, a second string of filaments in parallel with said first-mentioned string of filaments, and relay means included in said sealed envelope for initially energizing one of said strings of filaments and responsive to failure of said one of said strings to energize the other of said strings.

* * * * *